United States Patent [19]

Meylan et al.

[11] Patent Number: 4,884,951

[45] Date of Patent: Dec. 5, 1989

[54] METHOD OF CLAMPING BLADES

[75] Inventors: Pierre Meylan, Neuenhof; Peter Novacek, Gebenstorf, both of Switzerland

[73] Assignee: Asea Brown Boveri Ltd., Baden, Switzerland

[21] Appl. No.: 283,144

[22] Filed: Dec. 12, 1988

[30] Foreign Application Priority Data

Jan. 30, 1988 [DE] Fed. Rep. of Germany ..... 3802741

[51] Int. Cl.[4] ..... F01D 5/22

[52] U.S. Cl. ..... 416/191; 29/156.8 R; 29/445; 416/196 R; 416/500

[58] Field of Search ..... 416/191, 196 R, 500, 416/190, 221; 29/156.8 R, 445

[56] References Cited

U.S. PATENT DOCUMENTS

| | | | |
|---|---|---|---|
| 1,073,623 | 9/1913 | Owen et al. | 416/196 R X |
| 1,304,793 | 5/1919 | Moore | 416/191 |
| 2,237,121 | 4/1941 | Stine et al. . | |
| 2,510,734 | 6/1950 | Bodger | 416/191 |
| 2,681,500 | 6/1954 | Whitehead | 416/191 X |
| 4,155,152 | 5/1979 | Cretella et al. | 29/156.8 B |

FOREIGN PATENT DOCUMENTS

| | | | |
|---|---|---|---|
| 254227 | 5/1967 | Austria . | |
| 606351 | 11/1934 | Fed. Rep. of Germany | 416/191 |
| 1159965 | 7/1965 | Fed. Rep. of Germany . | |
| 1340331 | 9/1963 | France | 416/191 |
| 39807 | 3/1977 | Japan | 416/191 |
| 5523320 | 2/1980 | Japan . | |
| 241993 | 9/1946 | Switzerland | 416/220 R |
| 811921 | 4/1959 | United Kingdom | 416/191 |
| 2072760 | 10/1981 | United Kingdom | 416/191 |

*Primary Examiner*—Everette A. Powell, Jr.

*Attorney, Agent, or Firm*—Burns, Doane, Swecker & Mathis

[57] ABSTRACT

In order to clamp blades (1, 2, n) of turbomachines to influence the blade vibration occuring in such machines, the shroud plates (1a, 2a, na) are dimensioned in such a way that they are in contact with one another in the installed condition without clearance and without contact force or else they are dimensioned so that they exhibit a gap (3) relative to each other. A prestressed or pretorsioned, clearance-free connection occures between the shroud plates (1a, 2a, na) due to plastic deformation of the shroud plates (1a, 2a, na) in the region of their boundries or of the gap (3).

5 Claims, 1 Drawing Sheet

METHOD OF CLAMPING BLADES

BACKGROUND OF THE INVENTION

1. Field of the Invention

The present invention concerns a method of clamping blades of turbomachines in order to influence the blade vibrations occurring in such machines, the blades, being each provided with a shroud plate.

2. Dissussion of the Background

In turbomachines, the rotating blades are excited by, among other things, irregular incident flow. This excitation force often causes unallowable alternating stresses in the blades. In order to combat these dangerous vibrations, thickening the blade section can be considered as an obvious measure. This measure, however, causes a substantial deterioration in the efficiency and, for this reason, is not used.

Wherever it is possible to provide the blades with shroud plates, these are themselves used for damping an/or frequency modification and for stiffening. For this purpose, the flanks of the shroud plates are machined in such a way that they form surfaces of various shapes in contact with one another.

Although these measures exhibit certain advantages relative to the use of damping wires and pins, these shroud plate designs are subject to various other disadvantages, such as:

expensive machining of the contact surfaces complicated assembly varying contact surface forces depending on the operating condition mechanical wear of the surfaces in contact with one another, so that the desired damping continually deteriorates.

In order to help deal with these disadvantages, it has become the practice to install the blades with pre-torsion. For this purpose, the rhomboid-shaped shroud plates are provided with an excess dimension relative to the theoretically freely available pitch dimension so that the individual shroud plates and blade sections experience elastic deformation in the course of assembly. This is done by the application of a peripheral force and the blades are thus made to adopt a compact connection.

The damping and stiffening of the row of blades achievable by this means is, in itself, of good quality; with such a technique, however, it is found that both the assembly and removal of the blades is associated with disadvantages, particularly with respect to the assembly of the last blade of a group, where a large amount of effort has to be employed. In order to apply the peripheral force necessary for this purpose, special force generating equipment with a large force capability must be provided because of the relatively narrow space conditions there present. At times, however, this equipment is only suitable for certain types of machine so that the expense in each case is not unsubstantial.

SUMMARY OF THE INVENTION

Accordingly, one object of this invention as characterized in the claims, is to provide, in a method of the type mentioned at the beginning, a compact, prestressed, clearance-free connection between the individual shroud plates by means of the simplest non-machining deformation of the latter.

The essential advantage of the invention may be seen in the fact that the blades can now be fitted in a particular place without pre-torsion because the corresponding shroud plates have a small dimension relative to the theoretical pitch distance, or their peripheral length is equal to the theoretical pitch distance, i.e. they touch one another without contact force. In consequence, it is no longer necessary to exert a peripheral force in order to provide a compact connection between the individual shroud plates. A compact, clearance-free connection is now, and this provides a further important advantage of the invention, produced by upsetting, i.e. the shroud plates are plastically deformed in the region of the specified gap (or, if there is no clearance, in the region of their boundaries) by one or more upsetting processes, in such a way that prestress or pre-torsion occurs between the shroud plates. This upsetting process is also found to be particularly advantageous because the plastic deformation, which provides in the end the degree of compactness between the individual shroud plates, can be adapted from case to case.

Advantageous and desirable extensions of the way in which the objective is achieved according to the invention are characterized in the dependent claims.

One embodiment example of the invention is explained below using the drawing. All the elements which are unnecessary for direct understanding of the invention are omitted.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
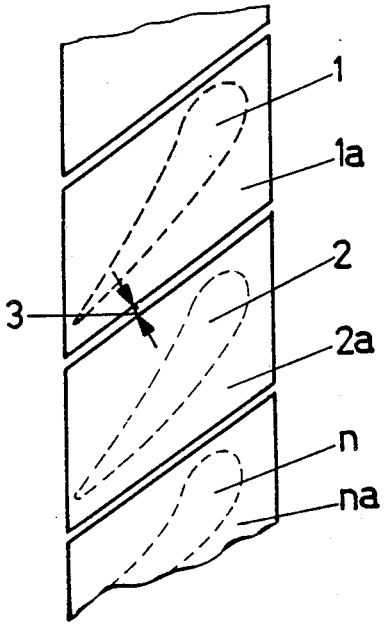
FIG. 1 shows a partial plan view of a shroud plate design, in the assembled condition.
Figure 2:
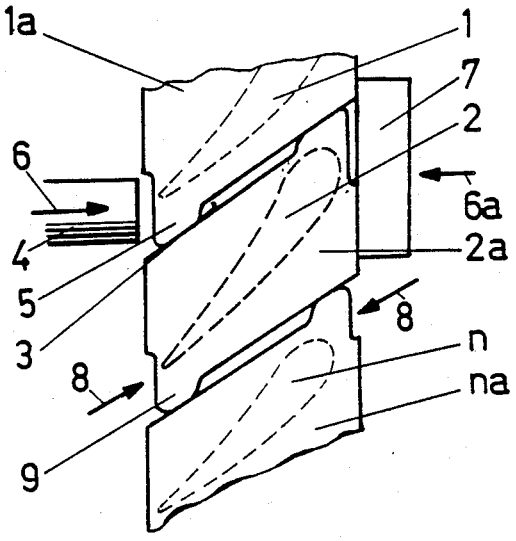
FIG. 2 shows the same shroud plate design after axial upsetting of the shroud plates has taken place in the region of the gap.

Referring now to the drawings, wherein like reference numerals designate identical or corresponding parts throughout the several views, FIG. 1 shows a partial plan view of a shroud plate design, the blades 1, 2, n being shown in the assembled condition. The shroud plates 1*a*, 2*a*, na are of rhomboid shape and each covers the blade body 1, 2, n located beneath it. In the installed condition, the shroud plates 1*a*, 2*a*, na have a gap 3 relative to each other in the peripheral direction (which is not however absolutely necessary). It has a size of up to 0.2 mm depending on the size and thickness of the shroud plates 1*a*, 2*a*, na used. It is therefore possible to fit the blades 1, 2, n in rows without having to act on the shroud plates 1*a*, 2*a*, na by the use of some force directed in the peripheral direction; a clearance will then certainly contribute to facilitating the fitting, particularly where the pitch distances of the blade root acceptance features in the rotor are not coincident. Because subsequent upsetting of the shroud plates 1*a*, 2*a*, na is undertaken in the region of this gap 3, smaller demands have to be made on the dimensional accuracy of this gap than would be the case if these shroud plates 1*a*, 2*a*, na had to be manufactured with an excess dimension relative to the pitch distance available. Even larger differences in the gap sizes can be dealt with by modified upsetting, either by providing a larger force for this purpose or by introducing the plastic deformation of the shroud plate material from a different plane. The way in which the plastic deformation of the shroud plate material is introduced in the region of the gap 3 can be undertaken is shown, for example, by FIG. 2–4. As may be seen from FIG. 2, the upsetting of the shroud plates 1*a*, 2*a*, na in the region of the gap 3 takes place in this case by the application of an axial contact. pressure force 6. This figure shows how the punch 4 is pressed against the side surface of the shroud plate 1a and there generates a depression 5 by plastic deformation of the shroud plate material; this depression 5 fills the gap 3 along a certain length. During this deformation procedure, a rail 7 on the opposite side ensures that the contact pressure force 6 acting on the punch 4 used does not have to be taken by the blade bodies 1 or 2. The opposing axial force 6*a* must, in consequence, be at least as large as the contact pressure force 6 required and used for the plastic deformation. This is necessary in order to ensure that no damaging force, for example shear forces, can act on the blade body 1, 2, n during the whole of the process. When one side of the shroud plate row has been deformed, the other side of the shroud plate row can be deformed in a mirror-image procedure following the same pattern. It is also possible to use a further operation to provide a subsequent upsetting 8. This is done if a finer plastic deformation of the depression 9 is desired or if the material thickness of the shroud plates 1*a*, 2*a*, na does not permit the final plastic deformation in one operation.

Figure 3:
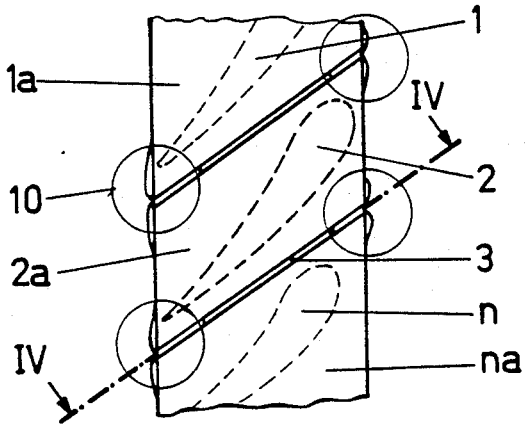
FIG. 3 and 4 show the same shroud plate design, but the upsetting of the shroud plates in the region of the gap has in this case taken place radially.
Figure 4:
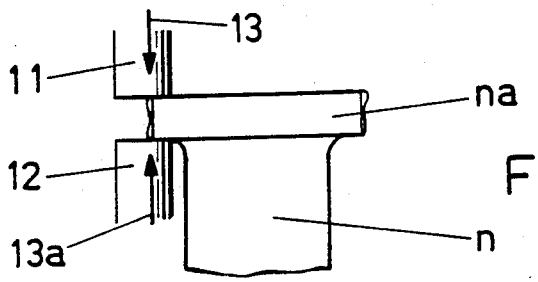

FIG. 3 and 4 show a further variant of a plastic deformation of the shroud plates 1*a*, 2*a*, na in the region of the gap 3. Two punches 11, 12 acting towards one another in the radial plane clamp, and in the region of the gap 3, two neighbouring shroud plates 1*a*, 2*a*/2*a*, na between them and, by exerting an equally large contact pressure force 13/13*a* on the shroud plates, produce plastic deformation of the latter at the boundary zones 10 encompassed by the punches 11, 12 in such a way that the gap 3 flows together in this region. This variant of the plastic deformation of the shroud plates is to be preferred because of its simple execution; it does, however, presuppose a minimum height of the blade bodies 1, 2, n so that the lower punch 12 can be applied to the rotor, not shown, in the installed condition of the blades.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Method of clamping blades of turbomachines in order to influence the blade vibrations occurring in such machines, the blades being each provided with a shroud plate, wherein the shroud plates (1*a*, 2*a*, na) are in contact with one another in the installed condition without clearance and without contact force, the shroud plates (1*a*, 2*a*, na) being plastically deformed in the region of their boundaries by the force action (6, 6*a*, 8, 13, 13*a*) at one or more positions (5, 9, 10) in such a way that a prestressed connection occurs between the shroud plates (1*a*, 2*a*, na).

2. Method of clamping blades of turbomachines in order to influence the blade vibrations occurring in such machines, the blades being each provided with a shroud plate, wherein the shroud plates (1*a*, 2*a*, na) have a gap (3) relative to one another in the installed condition, in the region of which gap the shroud plates (1*a*, 2*a*, na) are plastically deformed by force action (6, 6*a*, 8, 13, 13*a*) at one or more positions (5, 9, 10) in such a way that a prestressed, clearance-free connection occurs between the shroud plates (1*a*, 2*a*, na).

3. Method as claimed in claim 2, wherein the gap (3) is up to 0.2 mm in size.

4. Method as claimed in claims 1, wherein the force action (6, 6*a* and 8) acts on the shroud plates (1*a*, 2*a*, na) in the axial direction.

5. Method as claimed in claims 1, wherein the force action (13, 13*a*) acts on the shroud plates (1*a*, 2*a*, na) in the radial direction.

* * * * *